US009723400B2

(12) United States Patent
Herold et al.

(10) Patent No.: US 9,723,400 B2
(45) Date of Patent: Aug. 1, 2017

(54) INTEGRATED LOUDSPEAKER DEVICE HAVING AN ACOUSTIC CHAMBER CONTAINING SOUND ADSORBER MATERIAL

(71) Applicants: Josef Herold, Wulkaprodersdorf (AT); Christoph Schmauder, Vienna (AT)

(72) Inventors: Josef Herold, Wulkaprodersdorf (AT); Christoph Schmauder, Vienna (AT)

(73) Assignee: Sound Solutions International Co., Ltd., Beijing (CN)

( * ) Notice: Subject to any disclaimer, the term of this patent is extended or adjusted under 35 U.S.C. 154(b) by 0 days.

(21) Appl. No.: 14/818,045

(22) Filed: Aug. 4, 2015

(65) Prior Publication Data

US 2017/0041703 A1 Feb. 9, 2017

(51) Int. Cl.

| | |
|---|---|
| ***H04R 1/20*** | (2006.01) |
| ***H04R 1/28*** | (2006.01) |
| ***H04R 1/02*** | (2006.01) |

(52) U.S. Cl.

CPC ..... *H04R 1/288* (2013.01); *H04R 1/028* (2013.01); *H04R 2499/11* (2013.01)

(58) Field of Classification Search

CPC ..... H04R 2499/11; H04R 1/2803; H04R 2499/13; H04R 1/288; H04R 1/2834; H04R 1/2819

USPC ..... 381/353, 354, 345, 346; 181/145, 146, 181/160, 272, 105

See application file for complete search history.

(56) References Cited

U.S. PATENT DOCUMENTS

2007/0127759 A1* 6/2007 Zhang ..... H04R 1/342 381/338
2009/0120715 A1* 5/2009 Saiki ..... H04R 1/2803 181/151

(Continued)

FOREIGN PATENT DOCUMENTS

CN 204498347 U 7/2015
WO 2014059638 A1 10/2012

OTHER PUBLICATIONS

International Search Report (PCT/CN2016/093228).
Written Opinion of International Searching Authority (PCT/CN2016/093228).

*Primary Examiner* — Md S Elahee
*Assistant Examiner* — Julie X Dang
(74) *Attorney, Agent, or Firm* — Steven McMahon Zeller; Dykema Gossett PLLC

(57) ABSTRACT

An acoustic device having a housing and an acoustic transducer is disclosed. The housing has a transducer space for the acoustic transducer, and a back volume space. The back volume is filled with a sound adsorber material. The sound adsorber material in the back volume space is configured to virtually increase the size of the back volume space, and shift the resonant frequency of the back volume space. The acoustic chamber for the acoustic transducer and the sound adsorber material is integral to the split-shell housing of the acoustic device. The sound adsorber material is retained in a portion of the acoustic chamber by an acoustically permeable material that facilitates gas exchange within the back volume space, and between the sound adsorber material and the transducer space. The acoustically permeable material is configured in different arrangements to facilitate the gas exchange.

14 Claims, 10 Drawing Sheets

(56) References Cited

U.S. PATENT DOCUMENTS

| | | | | |
|---|---|---|---|---|
| 2009/0316920 | A1* | 12/2009 | Matsumura | H04R 1/2803 381/59 |
| 2010/0322453 | A1* | 12/2010 | Matsuyama | H04R 1/2857 381/380 |
| 2013/0108931 | A1* | 5/2013 | Hart | H01M 10/399 429/231.9 |
| 2013/0341118 | A1* | 12/2013 | Papakyriacou | H04R 1/2803 181/199 |
| 2016/0345090 | A1* | 11/2016 | Wilk | B01D 53/04 |

* cited by examiner

INTEGRATED LOUDSPEAKER DEVICE HAVING AN ACOUSTIC CHAMBER CONTAINING SOUND ADSORBER MATERIAL

FIELD OF THE INVENTION

The invention relates to the field of acoustic devices and, in particular, to miniature loudspeaker devices having sound adsorber materials integrated within the back volume portion of the housing of the loudspeaker device.

BACKGROUND OF THE INVENTION

In the acoustic arts, it is conventional to place a sound adsorber material in a back volume of a loudspeaker device to acoustically enlarge the back volume in a virtual sense. In a loudspeaker device having a physically small back volume, a sound adsorber material lowers the resonance frequency of the loudspeaker device to a value that is similar to a loudspeaker device with a physically larger back volume.

More specifically, sound adsorber materials disposed in the back volume of a loudspeaker device improve its sound characteristics, e.g., the wideband performance, and the apparent acoustic volume of the loudspeaker. Examples of sound adsorber materials include zeolite materials, zeolite-based materials, silica ($SiO_2$), alumina ($Al_2O_3$), zirconia ($ZrO_3$), magnesia (MgO), tri-iron tetroxide ($Fe_3O_4$), molecular sieves, fullerene, carbon nanotubes, and activated carbon or charcoal. Zeolite materials and zeolite-based materials are electrically isolating, unlike activated carbon. Since zeolite materials and zeolite-based materials are electrically non-conductive, they do not affect the electrical components (e.g., the antenna, the battery, the internal electronics, etc.) of a device that incorporates a loudspeaker device having such a sound adsorber material. In addition, the non-conductive zeolite material or zeolite-based material will not cause short circuits if it becomes loose within the device. Furthermore, the packaging of zeolite materials and zeolite-based materials is much easier than in case of activated carbon woven fabrics.

A problem may arise in the insertion or placement of sound adsorber materials consisting of or at least comprising powder, loose particles, or loose grains in the back volume of the loudspeaker device. Furthermore, the back volume of a miniature loudspeaker, such as a loudspeaker device placed in mobile phones, headsets, etc., is often constrained by other circuit components in the immediate physical area surrounding the loudspeaker, and sometimes the shape of the back volume is complex and not acoustically desirable. A conventional technique uses tubes that encase a sound adsorber material, but these usually do not fit well into a back volume having a complex shape. A direct insertion of the sound adsorber materials into the back volume can be practically difficult. Furthermore, if not securely packaged, the sound adsorber materials can enter the different components of the loudspeaker device, as well as the handheld device that uses the loudspeaker device, and can therefore damage the loudspeaker device, or the handheld device that includes the loudspeaker device as a component.

U.S. application Ser. No. 13/818,374, which is incorporated by reference in its entirety into this disclosure, discloses an audio system that comprises an electro-acoustic transducer or loudspeaker with a housing that forms a resonance volume to improve the quality of the emitted sound. The audio system disclosed in application Ser. No. 13/818,374 comprises a zeolite particulate material or a substantially ball-shaped zeolite granulate material that fills a portion of the resonance volume of a loudspeaker. Zeolite material is a sound adsorbing material that, depending on its formulation, results in a virtual acoustic enlargement of the volume of the resonance space by a factor of 1.5 or greater. As a result, the volume of the housing of the speaker that contains the zeolite material can be made smaller compared to a housing of a speaker filled with air.

The packaging of a zeolite-based material for use as a sound adsorber inside the back volume of a miniature loudspeaker, such as the type usually found in today's handheld consumer electronic devices, has been challenging. The zeolite materials disclosed in the application Ser. No. 13/818,374, although not electrically damaging, can interfere with the proper operation of a miniature loudspeaker, and potentially other components within a handheld consumer electronics device, if not properly contained within the device. In addition, due to the typically limited space within the back volume portion of a miniature loudspeaker, efficient gas exchange can be impeded and the efficiency of the zeolite-based sound adsorber can be lessened by design restrictions. Although the back volume of the miniature loudspeaker might be completely filled with a zeolite-based sound adsorber, if only a limited amount of sound adsorber surface area is exposed to pressure changes caused by acoustic transducer movement, the resonance frequency shift disclosed in application Ser. No. 13/818,374 is limited.

SUMMARY OF THE DISCLOSED INVENTION

The disclosed invention is directed to housing elements for a mobile device that, when joined, form an integral acoustic chamber for an acoustic transducer, such as a loudspeaker. The acoustic chamber has a back volume, a front volume, and a volume that is occupied by the acoustic transducer. In the back volume portion of the acoustic chamber, an amount of sound adsorber material is disposed within a chamber created by the walls of the acoustic chamber. The chamber containing the sound absorber material is sealed off from the remainder of the acoustic chamber with a gas permeable material that has low acoustic resistance. The gas permeable material retains the sound adsorber material in its designated chamber while permitting gas exchange between sound adsorber material and the remainder of the acoustic chamber to occur.

An embodiment of the housing for a mobile device according to the invention can comprise a printed circuit substrate, and a casing configured to mate with the printed circuit substrate to create the housing for an acoustic transducer in the mobile device. In the embodiment, the casing may comprise a chamber wall that defines a substantially sealed acoustic chamber when engaged with an interior surface of the printed circuit substrate, an acoustic transducer, such as a loudspeaker or receiver, disposed within the acoustic chamber, a sound port that is acoustically coupled to the acoustic transducer, an internal chamber wall disposed within the acoustic chamber and defining a back volume, and an amount of sound adsorber material disposed within the back volume. In the embodiment, a permeable member mechanically coupled to a top portion of the chamber wall and a top portion of the internal chamber wall, wherein the permeable member retains the sound adsorber material in a defined volume within the acoustic chamber. The permeable member of this embodiment has low acoustic resistance and may comprise one or more of a fleece material or a mesh material, and the pores of the material of the permeable member are adapted to be less that size of the sound adsorber granules. The permeable member is mechanically attached to the top portion of the chamber wall and the top portion of the internal chamber wall by gluing, crimping, stamping, embossing, heat-sealing, or ultrasonic welding. This embodiment may further comprise a chamber gasket interposed between the printed circuit substrate and the top portion of the chamber wall, wherein a thickness of the chamber gasket determines the size of a restriction through which gas exchange is facilitated. In addition, this embodiment can further comprise a sound port gasket interposed between the acoustic transducer and the sound port disposed in the casing, wherein the sound port gasket seals the front volume from the back volume. In this embodiment, in the acoustic chamber, the back volume portion is partially filled with zeolite-based substantially spherical sound adsorber granules having a minimum diameter of at least 300 microns.

Another embodiment of a housing for a mobile device may comprise a first housing element, the first housing element comprising a printed circuit board with an acoustic transducer electrically and mechanically coupled thereto, and a second housing element that mechanically couples to the first housing element to form the housing for the mobile device. In this embodiment, the second housing element may comprise a continuous vertical element that defines a substantially sealed acoustic chamber when engaged with the printed circuit board of the first housing element, a sound port disposed in a transducer space that is acoustically coupled to the acoustic transducer (e.g., a loudspeaker or a receiver), an internal vertical element disposed in the acoustic chamber and intersecting the continuous vertical element to define a back volume, an amount of sound adsorber granulate disposed within the back volume, and an acoustically transparent material mechanically coupled to a top portion of the continuous vertical element and a top portion of the internal vertical element, wherein the acoustically transparent material retains the sound adsorber granulate in a defined space within the acoustic chamber. In this embodiment, the acoustic transducer occupies the transducer space when the first housing element and the second housing element are coupled together. In this embodiment, the back volume portion of the acoustic chamber is partially filled with a zeolite-based sound adsorber granulate having substantially spherical granules with a minimum diameter of at least 200 microns, or, in another embodiment, a minimum diameter of at least 350 microns. This embodiment may comprise a chamber gasket interposed between the printed circuit board and the top portion of the continuous vertical element, wherein a thickness of the chamber gasket determines the size of a restriction through which gas exchange is facilitated. In this embodiment, the acoustically transparent material can be mechanically attached to the top portions of the continuous vertical element and the top portion of the internal vertical element by gluing or ultrasonic welding.

In a variation of this embodiment, the internal vertical element can comprise an opening configured to facilitate gas exchange for the sound adsorber granulate, wherein the opening may comprise a material that has substantially the same acoustic resistance as the acoustically transparent material mechanically coupled to the top portion of the continuous vertical element and the top portion of the internal vertical element, and the material disposed in the opening of the internal vertical element may comprise one or more of a fleece material or a mesh material. In a further variation, the internal vertical element may comprise an opening configured to facilitate gas exchange for the sound adsorber granulate, wherein the opening may comprise a material that has an acoustic resistance that is different from the acoustically transparent material mechanically coupled to the top portion of the continuous vertical element and the top portion of the internal vertical element. In some embodiments, the material disposed in the opening of the internal vertical element may comprise is a gas impermeable material that may comprise multiple pores sized to retain the sound adsorber granulate in a defined area in the back volume. In some embodiments, the housing may comprise a sound port gasket interposed between the acoustic transducer and the sound port disposed in the second housing element, wherein the sound port gasket is configured to seal the sound port from the back volume when the first and second housing elements are engaged.

Another embodiment of a housing for a mobile device may comprise a first housing element, the first housing element comprising a printed circuit board with an acoustic transducer (e.g., loudspeaker or receiver) electrically and mechanically coupled thereto, and a second housing element that mechanically couples to the first housing element to form the housing for the mobile device. The second housing can comprise a continuous vertical element that defines a substantially sealed acoustic chamber when engaged with the printed circuit board of the first housing element, a sound port disposed in a transducer space that is acoustically coupled to the acoustic transducer, an internal vertical element disposed in the acoustic chamber and intersecting the continuous vertical element to define a back volume. In this embodiment, the internal vertical element can comprise an opening configured for gas exchange, a low acoustic resistance insert that completely covers the opening, an amount of sound adsorber granulate disposed within the back volume, an acoustically transparent material mechanically coupled to a top portion of the continuous vertical element and a top portion of the internal vertical element, wherein the acoustically transparent material retains the sound adsorber granulate in a defined space within the acoustic chamber. This embodiment may also comprise a chamber gasket interposed between the printed circuit board, and the top portion of the continuous vertical element and the top portion of the internal vertical element. In this embodiment, the acoustic transducer occupies the transducer space when the first housing element and the second housing element are coupled together. In some embodiments, the low acoustic resistance insert in the internal vertical element and the acoustically transparent material each comprise one or more of a fleece material or a mesh material. In addition, in some embodiments, the back volume portion of the acoustic chamber is partially filled with a zeolite-based sound adsorber granulate having substantially spherical granules with a minimum diameter of at least 300 microns and a maximum diameter of 900 microns.

Embodiments of the housing for a mobile device can be manufactured in the following manner. After the casing has been substantially completed, it is ready to receive the sound adsorber material in the back volume portion of the acoustic chamber designated for the material. An amount of the sound adsorber material is measured and loaded into a dosing hopper. The casing is positioned beneath the dosing hopper, and vibrated as the sound adsorber material is poured into the designated portion, or portions, of the back volume of the acoustic chamber. If the back volume has multiple chambers, then the sound adsorber material measurement step and dosing step will be repeated as many times as necessary. After filling, the casing is vibrated multiple times to ensure that the sound adsorber material settles into the designated portion, or portions, of the acoustic chamber. A gas permeable member is then placed over the acoustic chamber and mechanically attached thereto, by gluing, ultrasonic welding, or other techniques. A chamber gasket is aligned with the walls of the acoustic chamber, and then the printed circuit substrate is joined to the casing, thereby completing the housing for the acoustic transducer of the mobile device.

Other embodiments of the housing for a mobile device can be manufactured in the following manner. After the casing has been substantially completed, it is ready to receive the sound adsorber material in the back volume portion of the acoustic chamber designated for the material. A gas permeable member is placed over the acoustic chamber that will receive the sound adsorber material and is mechanically attached thereto, by gluing, ultrasonic welding, or other techniques. An amount of the sound adsorber material is measured and loaded into a dosing hopper. The casing is positioned beneath the dosing hopper, and vibrated as the sound adsorber material is poured into the designated portion, or portions, of the back volume of the acoustic chamber through a dosing funnel that is aligned with a charging port disposed in the casing. If the back volume has multiple chambers, then the sound adsorber material measurement step and dosing step will be repeated as many times as necessary. After filling, the casing is vibrated multiple times to ensure that the sound adsorber material settles into the designated portion, or portions, of the acoustic chamber. A chamber gasket is aligned with the walls of the acoustic chamber, and then the printed circuit substrate is joined to the casing, thereby completing the housing for the acoustic transducer of the mobile device.

Other features and advantages of the disclosed invention will be apparent from the following specification taken in conjunction with the following drawings.

BRIEF DESCRIPTION OF THE DRAWINGS

The accompanying drawings, which are incorporated in and constitute a part of this specification, illustrate embodiments of the invention and, together with the description, serve to explain the objects, advantages, and principles of the invention. In the drawings.

Skilled artisans will appreciate that elements in the Figures are illustrated for simplicity and clarity. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION OF THE DISCLOSED EMBODIMENTS

A detailed description of disclosed embodiments will be provided with reference to the accompanying drawings.

Although the invention is susceptible to embodiments in many different forms, the drawings show, and as will be described in detail, preferred embodiments of the invention with the understanding that the present disclosure is to be considered as an exemplification of the principles of the invention and is not intended to limit the broad aspect of the invention to the embodiments illustrated.

Figure 1:
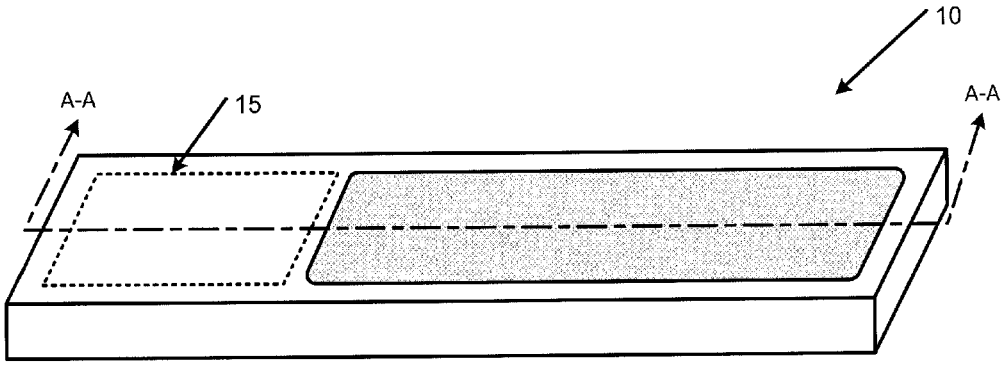
FIG. 1 is a three-quarters view of a loudspeaker device for mounting within an acoustic device.
Figure 2:
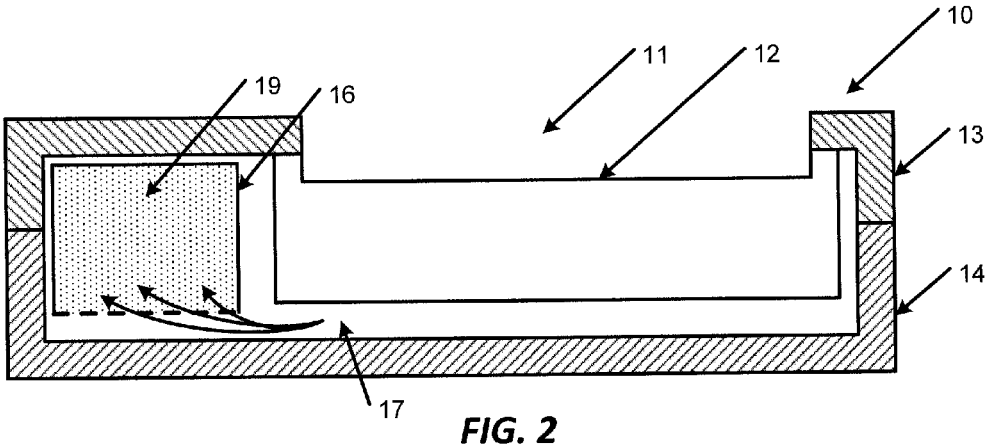
FIG. 2 is a longitudinal cross-sectional view of the loudspeaker device of FIG. 1 with a first embodiment for containing sound adsorber material.

Referring to FIGS. 1 and 2, a loudspeaker device 10 is illustrated. The loudspeaker device 10 comprises an upper loudspeaker housing 13, a lower loudspeaker housing 14, and an acoustic transducer 12. The upper loudspeaker housing 13 is joined to the lower loudspeaker housing 14 with fasteners, locking tabs, or a suitable adhesive. Preferably, the adhesive used to join the upper and lower loudspeaker housings 13, 14 does not have any outgassing characteristics that could affect the sound adsorber material in the back volume, and impact its effectiveness. The dotted lines 15 indicate the internal location of the sound adsorber material 19 in the loudspeaker device, as the sound adsorber 19 is internally disposed within the loudspeaker device 10. The upper loudspeaker housing 13 comprises a transducer opening that allows sound propagation/air flow from the acoustic transducer 12 into the space outside the device. Other elements of the loudspeaker device, such as electrical contacts, gaskets, and internal wiring, are not shown in FIG. 1.

Referring to FIG. 2, one method of packaging the sound adsorber material 19 is illustrated. As used herein, "sound adsorber material" refers to the zeolite materials disclosed in application Ser. No. 13/818,374, but other sound adsorber materials could be used if necessary. As shown in FIG. 2 along section line A-A, the back volume 17 of the loudspeaker device 10 extends around the acoustic transducer 12 and into the internal portion of the back volume where the sound adsorber pouch 16 is disposed. A technique of using a pouch to enclose the sound adsorber material 19 is disclosed in U.S. application Ser. No. 14/003,217, which is incorporated by reference in its entirety into this disclosure. As disclosed in application Ser. No. 14/003,217, the sound adsorber pouch 16 is manufactured to fit within the internal contours of the back volume, and one side of the sound adsorber pouch 16 comprises a gas permeable material having a low acoustic resistance that facilitates gas exchange between the back volume and the interior volume of the sound adsorber pouch 16. The gas permeable material must also retain the sound adsorber material 19 within the interior chamber of the pouch. The remaining sides of the sound adsorber pouch 16 are manufactured from a material that is relatively impermeable to gas, or has a high acoustic resistance. The sound adsorber pouch 16 is positioned such that gas exchange occurs between the sound adsorber material 19 and the back volume 17 through the permeable material.

Figure 3:
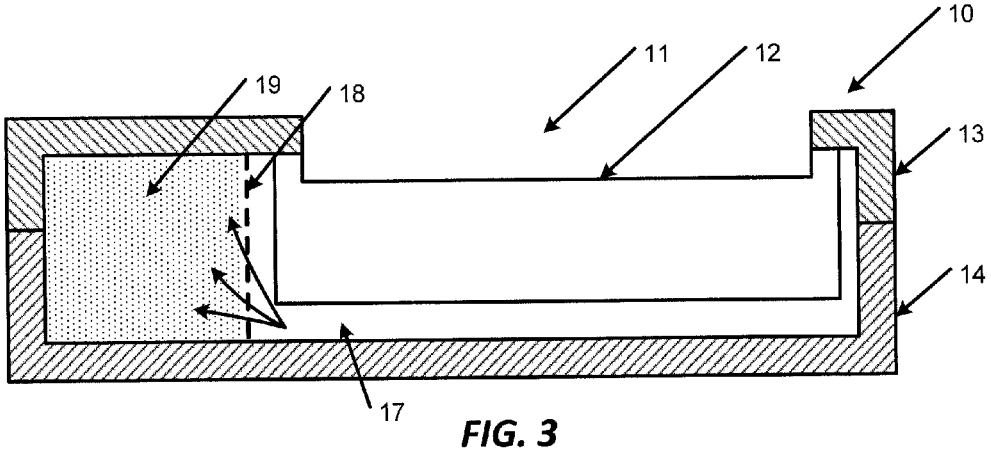
FIG. 3 is a longitudinal cross-sectional view of the loudspeaker device of FIG. 1 with a second embodiment for containing sound adsorber material.

Referring to FIG. 3, another method of retaining the sound adsorber material 19 within the back volume of the loudspeaker device 10 is illustrated. As shown in FIG. 3 along section line A-A, instead of a sound adsorber pouch 16, a permeable wall 18 is disposed within the back volume 17. The permeable wall 18 is retained in its position within the back volume 17 by tabs, flanges, or suitable adhesive. If an adhesive is used, it preferably does not have any outgassing characteristics that could affect the sound adsorber material in the back volume, and affect its sorption capabilities. The permeable wall 18 may comprise a punched or etched polypropylene material, a mesh material with low acoustic resistance, a filter material, or other gas permeable materials that have a low acoustic resistance. As shown in FIG. 3, the sound adsorber material 19 is retained in a portion of the back volume 17 that is opposite to the location of the acoustic transducer 12.

As shown in FIGS. 2 and 3, gas exchange between the sound adsorber material 19 and the back volume 17 is facilitated through a gas permeable material placed between the sound adsorber material 19 and the back volume 17. However, as shown in FIGS. 2 and 3, the sound adsorber material 19 that is at the interface with the back volume, i.e., immediately adjacent to the gas permeable material, will adsorb or desorb gas before the sound adsorber material 19 that is well away from the back volume interface. Even if the sound adsorber material 19 is a granulate (as opposed to much smaller particles), the sound adsorber material 19 presents acoustic resistance to the gas passing through the gas permeable material. This acoustic resistance causes the sound adsorber material 19 closest to the back volume interface to interact more with the gas exchange, whereas the sound adsorber further away from the gas permeable material can have less interaction. This uneven interaction in the gas exchange can cause a reduction in efficiency of the sound adsorber material 19 (if the path through sound adsorber material is too long/too narrow).

Figure 4:
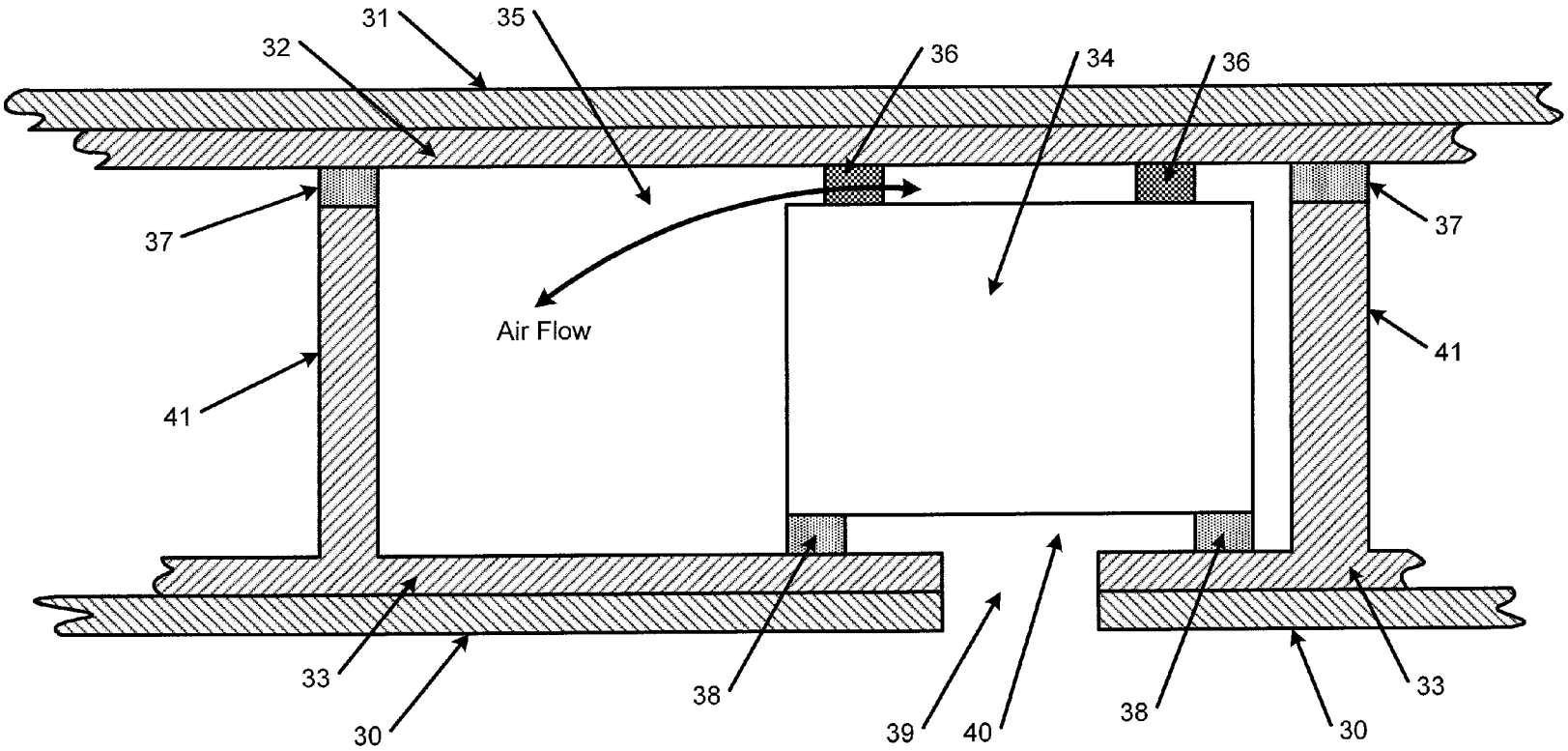
FIG. 4 is a longitudinal cross-sectional view of an acoustic device where a casing and a printed circuit board of the acoustic device provide the acoustic chamber for the enclosed acoustic transducer.

Referring to FIG. 4, an embodiment of an acoustic transducer 34 disposed in a substantially sealed acoustic chamber defined by the casing 33 and printed circuit board 32 of an audio device is depicted. In the context of this application, an audio device is inclusive of any type of electronics device, such as a music player, mobile phone, etc., that has an audio function, such as playback of voice messages, music, or other sound files. Audio devices that have a microphone are included as well, since the sound adsorber material could enhance the frequency response of the microphone element. In FIG. 4, the substantially sealed acoustic chamber is defined by the printed circuit board 32, the casing 33 with its chamber walls 41, and the chamber gasket 37 that is inserted between the top portions of the chamber walls 41 and the printed circuit board 32. In some embodiments, the chamber walls 41 are a continuous wall, and formed from injection molded plastic or machined from metal. Instead of a complete loudspeaker unit that has its own upper and lower loudspeaker housing shells, the embodiment shown in FIG. 4 relies upon printed circuit board 32 and the casing 33 to provide the loudspeaker housing. Typically, for this type of loudspeaker configuration, the loudspeaker is not completed until the printed circuit board 32 and the casing 33 for the audio device are joined.

The sound port 39 allows sound propagation to the environment outside the chamber formed by the printed circuit board 32 and casing 33 and the chamber gasket 37. The acoustic transducer 34 is electrically and mechanically coupled to the printed circuit board 32 via the transducer contacts 36 that are disposed between the printed circuit board 32 and the acoustic transducer 34. Solder or other conductive materials can be used to electrically and mechanically couple the acoustic transducer 34 to the printed circuit board 32. Alternatively, the acoustic transducer 34 may have spring contacts that press against the printed circuit board 32 to provide electrical continuity. The acoustic transducer 34 receives electrical signals from the printed circuit board 32 via the transducer contacts 36.

The acoustic transducer 34 is spaced away from the sound port 39 and the interior surface of the casing 33 by the sound port gasket 38. The sound port gasket 38 divides the substantially sealed acoustic chamber into a front volume 40 and a back volume 35. The front volume 40 is the volume accessible through the sound port 39 and delimited by the sound port gasket 38, the portion of the interior surface of the casing 33 within the sound port gasket 38, and the portion of the acoustic transducer 34 facing the sound port 39. The back volume 35 of the substantially sealed acoustic chamber is delimited by the portion of the interior surfaces of the casing 33 outside the sound port gasket 38, the interior surfaces of the chamber walls 41, the chamber gasket 37, and the portion of the interior surface of the printed circuit board 32 within the chamber gasket 37. Other portions of the printed circuit board 32 are mechanically coupled to the casing 33 to compress the chamber gasket 37 against the top portions of the chamber walls 41, and to compress the sound port gasket 38 against the acoustic transducer 34 and the interior surface of the casing 33 in the region of the sound port 39. The compression of the chamber gasket 37 and the sound port gasket 38 substantially seals the acoustic chamber for the acoustic transducer 34. As is well known, the back volume 35 improves the operation of the acoustic transducer, in this instance a loudspeaker. The air flow from the rear side of the acoustic transducer 34 into the back volume 35 during movement of the acoustic transducer 34 due to electrical signals received through the transducer contacts 36 is shown in FIG. 4.

FIG. 4 also depicts a casing shell 30 and a PCB shell 31, where the casing shell 30 is mounted on the casing 33 and the PCB shell 31 is mounted on the printed circuit board 32. The casing shell 30 and the PCB shell 31 are optional components of the audio device, and are typically included for aesthetic reasons to cover the casing 33 and the printed circuit board 32. More specifically, the casing 33 might have mold parting lines, fastener ports, or machining lines that are not aesthetically pleasing, and the casing shell 30 is attached to the casing 33 to cover those manufacturing artifacts. Similarly, the PCB shell 31 is mounted on the printed circuit board 32 to cover wiring, electrical traces, and other manufacturing artifacts.

Figure 5:
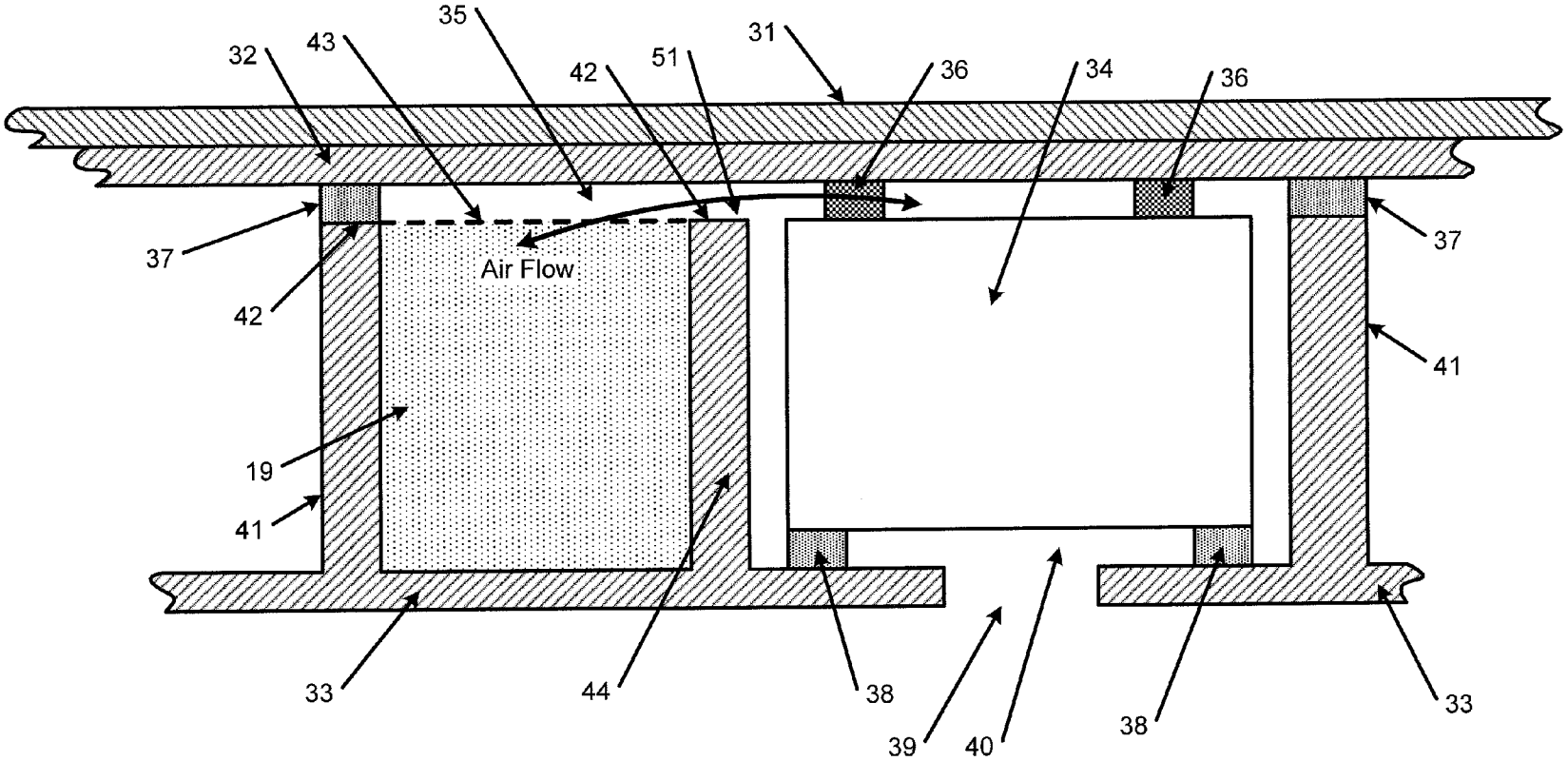
FIG. 5 is a longitudinal cross-sectional view of an acoustic device where a casing and a printed circuit board of the acoustic device provide the acoustic chamber for the enclosed acoustic transducer and sound adsorber material according to a first embodiment of the invention.

Referring to FIG. 5, an embodiment of an acoustic transducer 34 disposed in a substantially sealed acoustic chamber with a sound adsorber material 19, the substantially sealed acoustic chamber defined by the printed circuit board 32 and casing 33 of an audio device, is depicted. Most of the structural features of the embodiment of FIG. 5 are identical to those shown in FIG. 4. In the embodiment shown in FIG. 5, the back volume 35 is now occupied by an amount of sound adsorber material 19, an internal chamber wall 44, and the permeable member 43 that contains the sound adsorber material 19 within the volume defined by the internal chamber wall 44, the chamber wall 41, and the permeable member 43. The permeable member 43 is mechanically coupled or attached to permeable member attachment point 42 on the top portions of the chamber wall 41 and the internal chamber wall 44. The permeable member 43 only covers those portions of the substantially sealed acoustic chamber (i.e., the back volume 35) that will receive the sound adsorber material 19. Other portions of the substantially sealed acoustic chamber, such as the portion where the acoustic transducer is located, will not be covered with the permeable member 43. This allows repair and replacement of the acoustic transducer 34 without having to remove the permeable member 43 or disturb the sound adsorber material 19. The chamber gasket 37 covers the portion of the permeable member 43 that is mechanically coupled or attached to the top portion of the chamber wall 41.

Although FIG. 5 only discloses a single back volume 35 that will contain the sound absorber material 19, it is contemplated that the back volume 35 could comprise multiple chamber-type areas within the entirety of the substantially sealed acoustic chamber defined by the chamber walls 41, the casing 33, and the printed circuit board 32. It is further contemplated that each of these multiple chamber-type areas within the substantially sealed acoustic chamber would be covered by the permeable member 43, preferably by a single piece of permeable member 43 that is configured to cover all the chamber-type areas. It is also contemplated that multiple permeable members 43 might be required as well, depending upon the overall design of the substantially sealed acoustic chamber defined by the chamber walls 41, the casing 33, and the printed circuit board 32. Also, to facilitate repair or replacement of the acoustic transducer 34, a permeable member 43 that covers multiple chambers containing the sound adsorber material 19 will not cover the volume in the acoustic chamber designated to the occupied by the acoustic transducer.

As shown in FIG. 2, a sound absorber pouch 16 containing a sound adsorber material 19 might be used in this type of speaker configuration, where the speaker housing is molded into or is an integral portion of the housing for an audio device. One limitation of the sound adsorber pouch 16 is that corners of the back volume 35, as shown in FIGS. 4 and 5, will not have any sound material disposed therein. This is due to manufacturing limitations inherent in the sound adsorber pouch 16. More specifically, ninety-degree corners cannot be molded into the sound adsorber pouch 16 and also some tolerances for proper pouch placement in the back volume 35 are needed, and thus small amounts of the back volume 35 do not receive sound adsorber material 19. The other method shown in FIG. 3 would not be suitable for this type of speaker configuration, where the speaker housing is molded into or is an integral portion of the housing for an audio device, as the fill port for the sound adsorber material 19 would be visible on the housing of the audio device, and not aesthetically pleasing to potential device purchasers. In addition, there is a danger that regular everyday use of the audio device would cause the seal over the fill port to become dislodged or broken, thereby allowing the sound adsorber material to escape.

The air flow from the rear side of the acoustic transducer 34 into the back volume 35 during movement of the acoustic transducer 34 due to electrical signals received through the transducer contacts 36 is shown in FIG. 5. During operation, the acoustic transducer 34 generates pressure in the back volume 35, and this pressure causes gas exchange to occur with the sound adsorber material 19. The permeable member 43 facilitates this gas exchange between the back volume 35 and the sound adsorber material 19. Preferably, the sound adsorber material 19 is a loose zeolite granulate material as disclosed in U.S. application Ser. No. 14/818,374, which is incorporated by reference in its entirety. More preferably, the loose zeolite granulate material, for use as the sound adsorber material 19, is substantially spherical and has a diameter range of 100 microns or greater. The loose zeolite granulate material is preferable for its ease of use in manufacturing an acoustic device of the type disclosed herein. Other types of sound adsorber material, such as zeolite powder or activated charcoal, can be used as well, but might not be as easy to use in the manufacturing processes.

As is known in the art, the ability of sound or gases to pass through a material can be described with acoustic resistance (i.e., measured in MKS rayls). For the embodiment shown in FIG. 5, the permeable material 43 should have an acoustic resistance below a certain threshold for a typical volume size behind the permeable material 43 (in this case 1 cubic centimeter), typically 260 MKS rayls. If the opening is small, the selection of material to be used as the permeable member 43 might cause the acoustic resistance at the opening to exceed the 260 MKS rayls threshold limit, thereby leading to acoustical poor performance. More specifically, if the 260 MKS rayls threshold limit is exceeded, the gases in the back volume will be impeded from reaching the sound adsorber material 19. Thus, if a fleece material is selected for use as the permeable member 43, care must be taken that the 260 MKS rayls threshold limit is not exceeded, especially if the restriction 51 is small. For some embodiments, the fleece material is an inhomogeneous material, and more specifically, is a flat sheet of material made from nylon fibers with an undefined pattern. The purpose of the fleece material is to retain the sound adsorber material 19, and to allow gases to interact with the sound adsorber material 19. The structure of the fleece material and any pores therein is such that the sound adsorber material 19, whether in powder form, particle form, or grain form, cannot pass through the fleece material.

Alternatively, a mesh material can be used for the permeable member 43. In some embodiments, unlike the fleece material, the surface structure, and the material structure, of the mesh material is well-defined. For example, a sheet of mesh material suitable for use as the permeable member 43 might have a nominal thickness of 115 micrometers, a pore size of 130 micrometers, and an acoustic resistance of 8.5 MKS rayls per square centimeter. Like the fleece material, the purpose of the mesh material is to retain the sound adsorber material 19, and to allow gases to interact with the sound adsorber material 19. The structure of the mesh material and any pores therein is such that the sound adsorber material 19, whether in powder form, particle form, or grain form, cannot pass through the mesh material. An acoustic engineer has wider design latitude with the mesh material, since its acoustic resistance is low and is a known quantity.

The permeable member 43 can be coupled to the permeable member attachment points 42 on the top portions of the chamber wall 41 and the internal chamber wall 44 by gluing, crimping, stamping, embossing, heat sealing, or, preferably by ultrasonic welding. A benefit of ultrasonic welding is that a consistent and reliable bond is formed between the permeable member 43 and the top portions of the chamber wall 41 and the internal chamber wall 44, with the permeable member 43 being a fleece or mesh material. Ultrasonically welding causes the materials to fuse, forming a strong mechanical joint as the materials fuse together. Typically, ultrasonic welding softens the fibers in the mesh material, but does not melt them. The ultrasonic welding technique ensures that the material that comprises the permeable member 43 is securely fastened to the top portions of the chamber wall 41 and the internal chamber wall 44, thereby preventing any leakage of the sound adsorber material 19 while still allowing gas to interact with the sound adsorber material 19.

Another feature of using the permeable member 43 for retaining the sound adsorber material 19 is that the acoustic transducer 34 can be repaired or replaced without disturbing or losing the sound adsorber material 19. The secure attachment of the permeable member 43 to the top portions of the chamber wall 41 and the internal chamber wall 44 prevents the escape of the sound adsorber material 19 from its designated volume.

As shown in FIG. 5, the restriction 51 is the passage between the top portion of the internal chamber wall 44 and the interior surface of the printed circuit board 32. The size of the restriction 51 is based on the thickness of the chamber gasket 37. Preferably, the thickness of the chamber gasket 37 is 0.3 millimeters, but other thicknesses can be used to adjust the height of the restriction 51.

In the embodiment shown in FIG. 5, the internal chamber wall 44 is formed from a solid material, preferably injection molded plastic or machined metal. In the loudspeaker embodiments shown in FIGS. 2 and 3, the limited amount of surface area exposure of the sound adsorber material 19 can impact the performance of the sound adsorber material 19. More specifically, the sound adsorber material 19 that is further away from the permeable material that facilitates gas exchange between the sound adsorber material 19 and the back volume does not undergo the same amount of air flow/air velocity as the sound adsorber material 19 that is close to the permeable material, since air flow close to the acoustic transducer is high and the air flow is low at the far end of the back volume at the wall. This is due to the acoustical spring formed by the closed back volume and the sound adsorber material 19 itself presenting a certain amount of acoustic resistance to the gas being pushed into the volume occupied by the sound adsorber material 19. In addition, the gas exchange has to flow through a restriction 51 between the top surface of the internal chamber wall 44 and the printed circuit board 32. The restriction 51 can present additional acoustic resistance as well if it gets too small.

The embodiment shown in FIG. 5 only has the PCB shell 31, and not the casing shell 30. In this embodiment, the exterior surface of the casing 33 has been finished to present an aesthetically pleasing surface to the device purchaser, and thus the casing shell 30 is extraneous. The PCB shell 31 is present due to the electrical traces of the printed circuit board 32.

Figure 6:
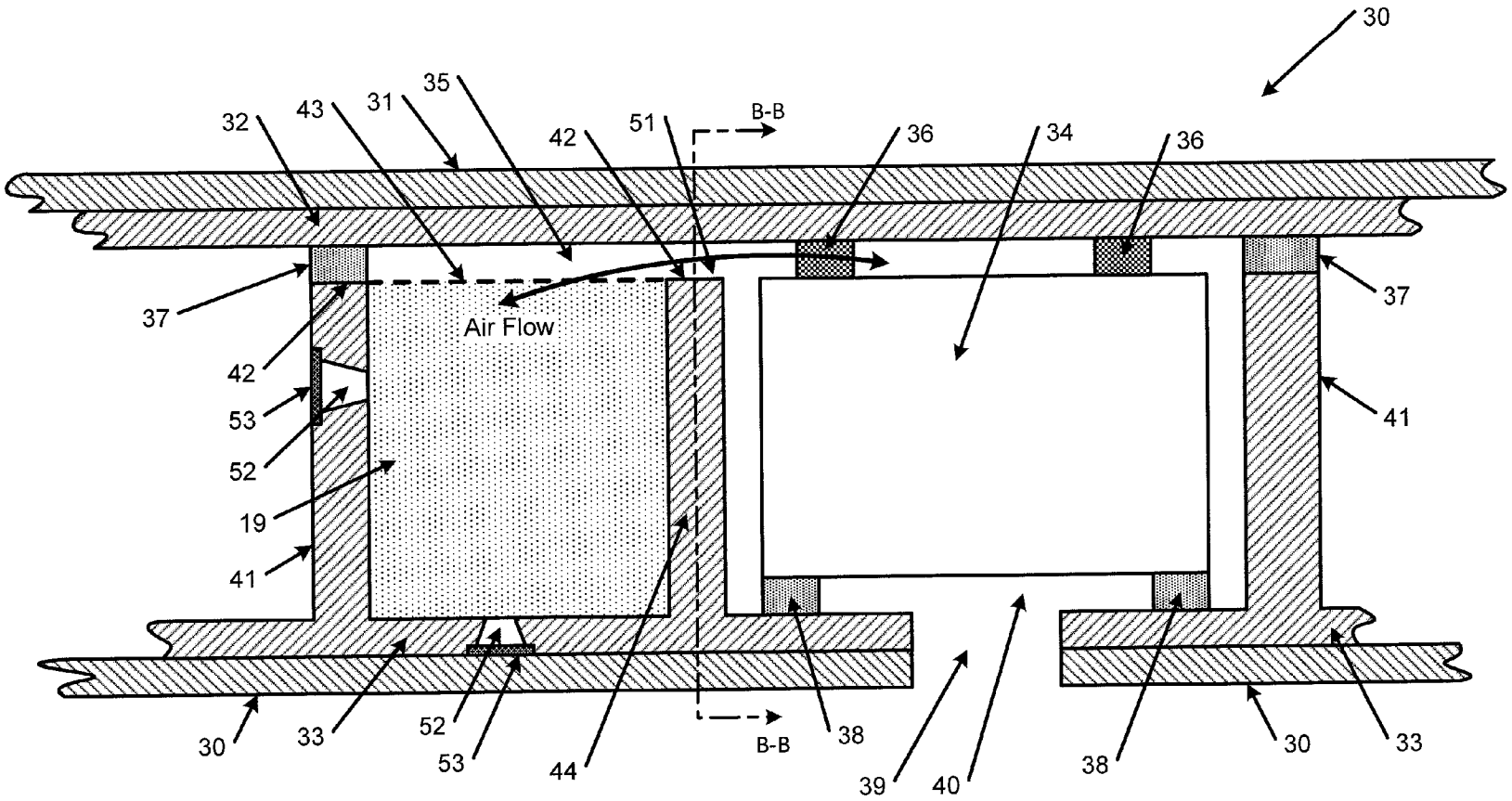
FIG. 6 is a longitudinal cross-sectional view of an acoustic device where a casing and a printed circuit board of the acoustic device provide the acoustic chamber for the enclosed acoustic transducer and sound adsorber material according to a second embodiment of the invention.

Referring to FIG. 6, another embodiment of an acoustic transducer 34 disposed in a substantially sealed acoustic chamber with a sound adsorber material 19, the substantially sealed acoustic chamber defined by the printed circuit board 32 and casing 33 of an audio device, is depicted. Most of the structural features of the embodiment of FIG. 6 are identical to those shown in FIG. 5. In the embodiment shown in FIG. 6, the back volume 35 is now occupied by an amount of sound adsorber material 19, an internal chamber wall 44, and the permeable member 43 that contains the sound adsorber material 19 within the volume defined by the internal chamber wall 44, the chamber wall 41, and the permeable member 43. The permeable member 43 is mechanically coupled or attached to permeable member attachment point 42 on the top portions of the chamber wall 41 and the internal chamber wall 44. The permeable member 43 only covers those portions of the substantially sealed acoustic chamber (i.e., the back volume 35) that will receive the sound adsorber material 19. Other portions of the substantially sealed acoustic chamber, such as the portion where the acoustic transducer 34 is located, will not be covered with the permeable member 43. This allows repair and replacement of the acoustic transducer 34 without having to remove the permeable member 43 or disturb the sound adsorber material 19. The chamber gasket 37 covers the portion of the permeable member 43 that is mechanically coupled or attached to the top portion of the chamber wall 41.

In the casing 33, a charging port 52 is shown. The charging port 52 is located in the bottom surface of the casing 33, and provides a port between the portion of the back volume 35 that is filled with the sound adsorber material 19 and the exterior of the casing 33. The charging port 52 is used to facilitate a particular technique for loading a specific type of sound adsorber material 19 into the back volume. The charging port 52 is covered with a charging port seal 53. The charging port seal 53 can be made from a foil or film material, and can be self-adhesive. Any adhesive used near the sound adsorber material 19 should not adversely affect the performance of the sound adsorber material. Preferably, the portion of the charging port 52 that is on the exterior of the casing 33 has a countersunk cavity or ring around its diameter that accommodates the charging port seal 53, and thus the charging port seal 53 is flush with the exterior surface of the casing 33. Preferably, the size of the charging port is at least 1.5 millimeters in diameter. FIG. 6 illustrates two charging ports 52, one located in the bottom surface of the casing 33 and one located in the chamber wall 41, in actual practice only one charging port 52 would be used. The location of the charging port 52 would depend on several factors, such as the design of the casing 33, the physical complexity of the back volume area designated to contain the sound adsorber material 19, and the manufacturing sequence for populating the casing 33 with other components and inserting the sound adsorber material 19. Unlike the embodiment shown in FIG. 5, the embodiment in FIG. 6 comprises a casing shell 30, since the casing 33 might have mold parting lines, fastener ports, or machining lines that are not aesthetically pleasing, and the casing 33 might have a charging port 52 with a charging port seal 53 that needs to be covered.

Although FIGS. 5 and 6 only disclose a single back volume 35 that will contain the sound absorber material 19, it is contemplated that the back volume 35 could comprise multiple chamber-type areas within the entirety of the substantially sealed acoustic chamber defined by the chamber walls 41, the casing 33, and the printed circuit board 32. It is further contemplated that each of these multiple chamber-type areas within the substantially sealed acoustic chamber would be covered by the permeable member 43, preferably by a single piece of permeable member 43 that is configured to cover all the chamber-type areas. It is also contemplated that multiple permeable members 43 might be required, depending upon the overall design of the substantially sealed acoustic chamber defined by the chamber walls 41, the casing 33, and the printed circuit board 32. In addition, to facilitate repair or replacement of the acoustic transducer 34, a permeable member 43 that covers multiple chambers containing the sound adsorber material 19 will not cover the volume in the acoustic chamber designated to the occupied by the acoustic transducer.

The embodiment shown in FIG. 6 has the PCB shell 31 and the casing shell 30. In this embodiment, even though the exterior surface of the casing 33 could be finished to present an aesthetically pleasing surface to the device purchaser, if the charging port 52 is disposed such that it pierces the exterior surface of the casing 33, there is a danger that that charging port seal 53 could become damaged or dislodged, the sound adsorber material 19 could be contaminated or could leak out from the back volume. Thus, the casing shell 30 protects the charging port seal 53 and provides an aesthetically pleasing surface to the device purchaser. The PCB shell 31 is present due to the electrical traces of the printed circuit board 32.

Figure 7:
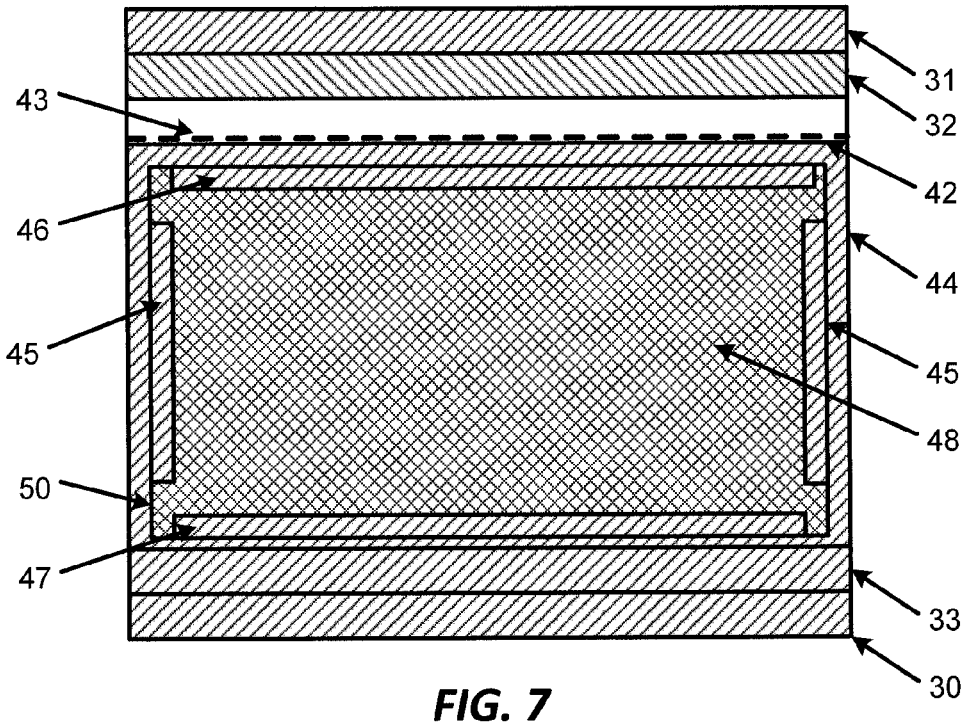
FIG. 7 is a cross-sectional view of a first embodiment of an internal chamber wall according to the invention.
Figure 8:
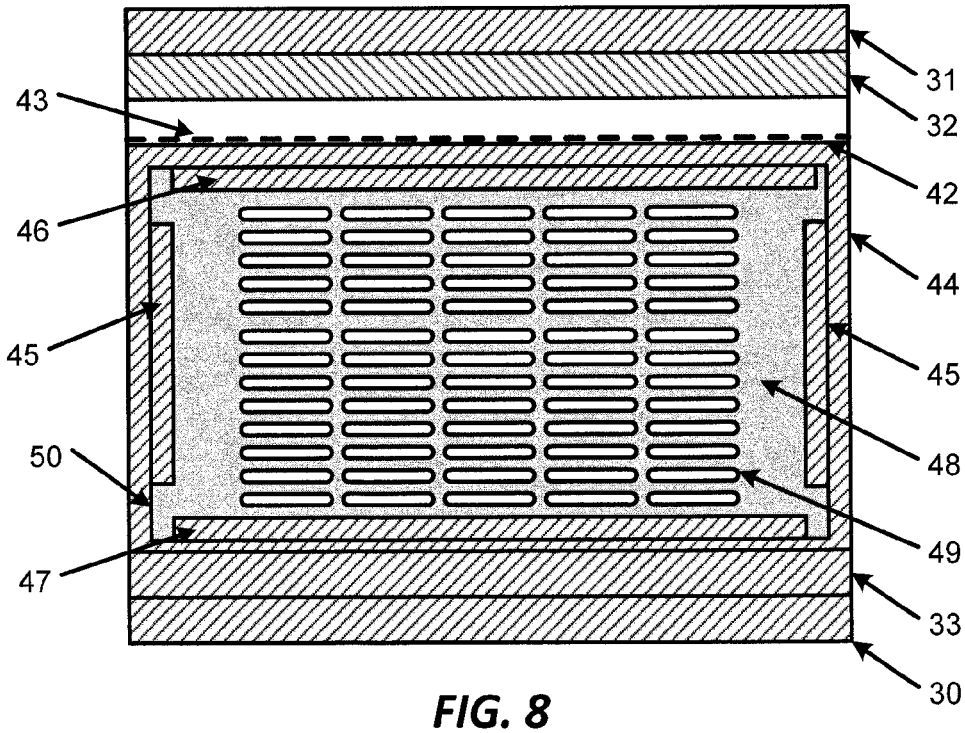
FIG. 8 is a cross-sectional view of a second embodiment of an internal chamber wall according to the invention.

FIGS. 7 and 8 are views of the acoustic device 30 along section line B-B. Referring to FIG. 7, a wall opening 50 is provided in the internal chamber wall 44. In the wall opening 50, there are provided an upper tab 46, side tabs 45, and a lower tab 47. These tabs can be a long solid piece of material as shown in FIG. 7, or can be a series of tabs that occupy substantially the same space as the long solid piece of material shown in FIG. 7. The tabs 45, 46, 47 can be injection-molded plastic, machined metal, or other suitable materials. A permeable insert 48 is disposed in the wall opening 50, and is retained in that position by the upper tab 46, the side tabs 45, and the lower tab 47. The permeable insert 48 retains the sound adsorber material 19 in the chamber delimited by the chamber wall 41, the internal chamber wall 44, and the permeable member 43. The permeable insert 48 also expands the amount of exposed surface area of the sound adsorber material 19. Thus, gas exchange occurs through the permeable member 43 and the permeable insert 48, thereby improving the efficiency of the sound adsorber material 19. The permeable insert 48 can be manufactured from the same materials discussed above for the permeable member 43, and should have an acoustic resistance in MKS rayls below the threshold established for the permeable member 43.

Referring to FIG. 8, another embodiment of the permeable insert 48 is shown. In this embodiment, a non-permeable material is etched, punched, or otherwise machined to have a plurality of vents 49. The vents 49 are sized to prevent the passage of the sound adsorber material 19 through the vents, while allowing gas exchange between the back volume 35 and the sound adsorber material 19 to occur. Preferably, polypropylene foil is used to create the permeable insert 48. There are several reasons why polypropylene foil is an ideal material for the permeable insert 48. Polypropylene foil does not become brittle as it ages, it is highly resistant to damaging ultraviolet light, and it resists damage from several types of chemicals. In general, polypropylene foil has a very low density of less than 1 gram/$cm^3$ and most foils are heat-resistant up to 140 degrees Celsius. Similar materials, such as Kapton, could be used as well. The vents 49 can be formed in a variety of geometric shapes and sizes, as long as the vents 49 do not exceed a predetermined acoustic resistance threshold (preferably 260 MKS rayls).

Figure 9:
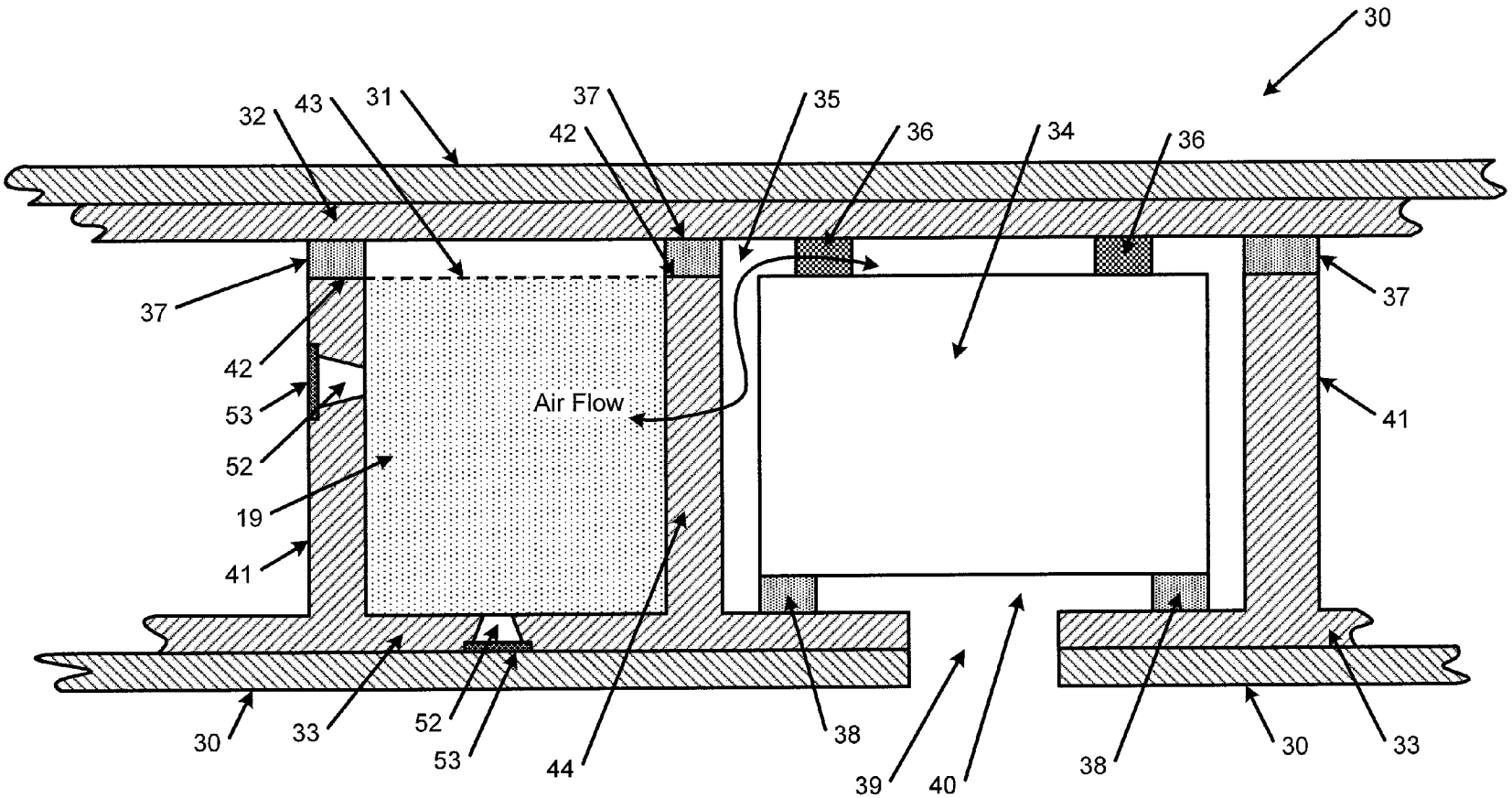
FIG. 9 is a longitudinal cross-sectional view of an acoustic device where a casing and a printed circuit board of the acoustic device provide the acoustic chamber for the enclosed acoustic transducer and sound adsorber material according to a third embodiment of the invention.

Referring to FIG. 9, the embodiment illustrated therein is based on the internal chamber wall 44 embodiments shown in FIGS. 7 and 8. The chamber gasket 37 has been expanded to include a portion that is disposed between the top portion of the internal chamber wall 44 and the printed circuit board 32. Since the wall opening 50 and the permeable insert 48 permit the exchange of gases between the back volume 35 and the sound adsorber material 19, the additional portion of the chamber gasket 37 closes off the acoustic path along the printed circuit board 32, and routes the gases to the wall opening 50. While it might appear that the permeable member 43 is now superfluous, it is still needed to retain the sound adsorber material 19 in its defined volume in case the acoustic transducer 34 needs to be repaired or replaced.

Figure 10A:
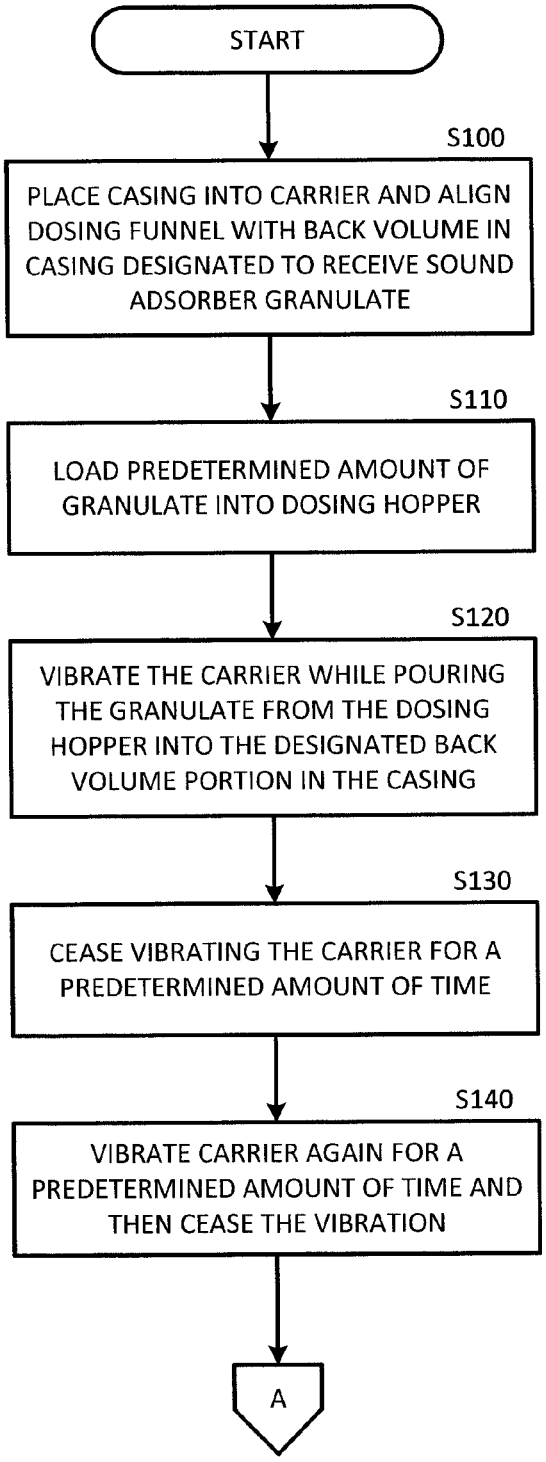
FIGS. 10A and 10B is a process flow for manufacturing an acoustic device where a casing and a printed circuit board of the acoustic device provide the acoustic chamber for the enclosed acoustic transducer and sound adsorber material according to an embodiment of the invention.
Figure 10B:
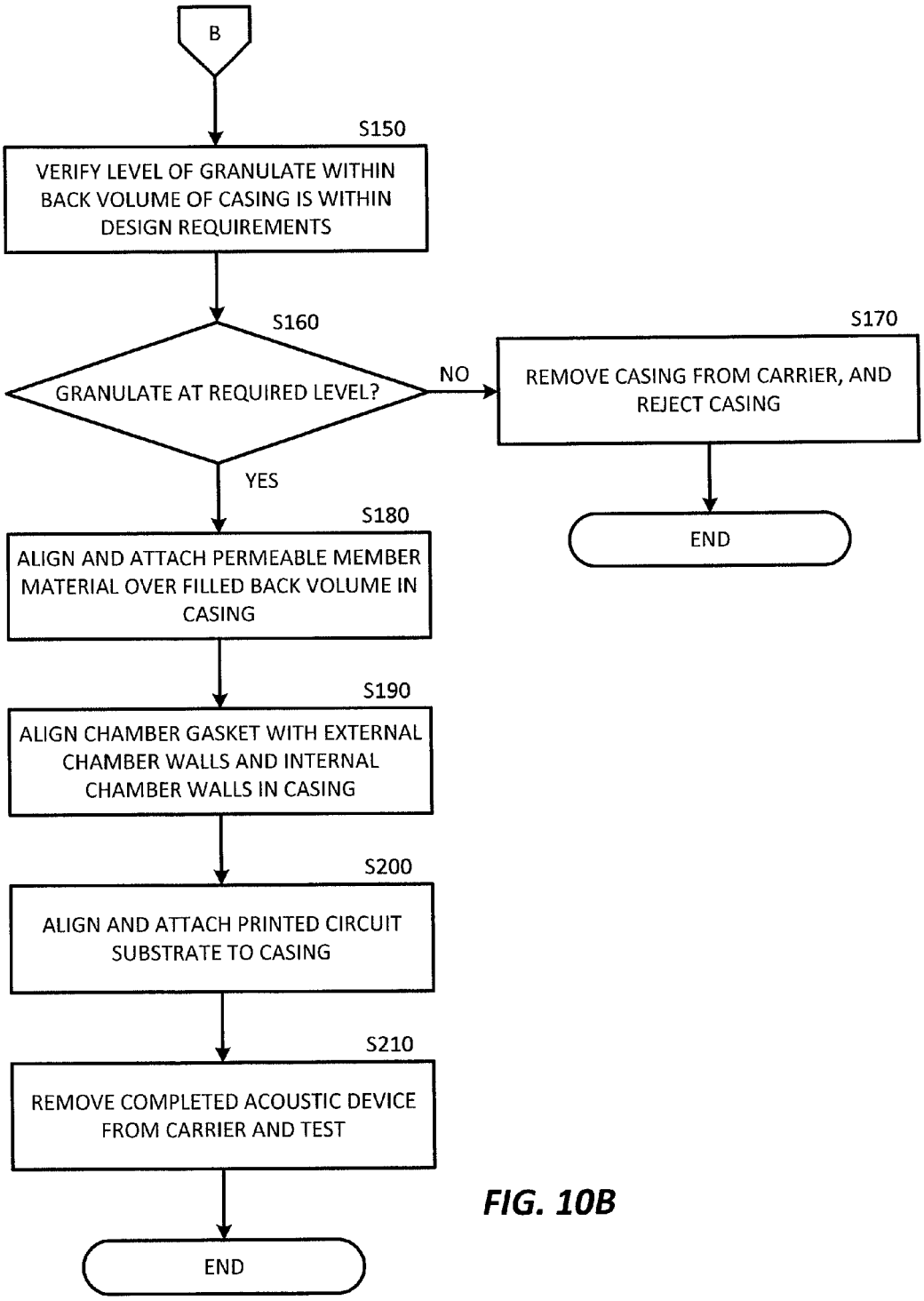

Referring to FIGS. 10A-10B, a method for manufacturing an audio device having a loudspeaker housing as an integral portion of its housing shell is disclosed. Preferably, the manufacturing method is implemented with computer-controlled manufacturing equipment for the greatest efficiency, although manual assembly of the audio device is contemplated as well. More specifically, the description of the manufacturing process assumes that the audio device undergoing assembly has been placed in an assembly carrier that moves the audio device through various computer-controlled assembly stations along an assembly track. There might be other steps, such as inserting gaskets or making electrical connections, that are not described in the manufacturing method. These types of steps, however, are generic to the manufacturing process and are not part of the invention.

Referring to FIGS. 10A and 10B, an embodiment of the manufacturing method for an audio device having a loudspeaker housing as an integral portion of its housing shell is disclosed will be described. At Step S100, the casing 33 is placed into an assembly carrier, and the dosing funnel is aligned with the back volume 35 of the casing 33. At this stage of the manufacturing process, the audio device being assembled is situated in an assembly carrier, and preferably, the assembly carrier assists in the alignment of dosing funnel with the back volume 35 in the casing 33. Alternatively, the dosing funnel can be manually aligned with the back volume 35 in the casing 33. The purpose of the dosing funnel is to ensure all the measured dose of sound adsorber material enters the back volume 35 in the casing 33. Preferably, a zeolite material having a substantially spherical shape is used as the sound adsorber material, and the form of this zeolite material is preferable for filling the back volume of a closed casing 33. At this stage of the manufacturing process of the acoustic device, it is assumed that no other components need to be mounted in the casing 33, except for the acoustic transducer 34. While additional components can be added after the placement of the sound adsorber material 19 in the back volume 35, there is a risk of disturbing or contaminating the sound adsorber material 19.

At Step S110, a predetermined amount of the sound adsorber material is loaded into the dosing hopper. The amount of sound adsorber material that will be loaded into the back volume 35 in the casing 33 is determined based upon the desired acoustic effects that the designer wishes to achieve. For example, the amount of sound adsorber material 19 deposited into the back volume 35 in the casing 33 is dependent upon how much of a resonance shift the acoustic design engineer wishes to achieve. The measurement of the amount of sound adsorber material 19 for insertion into the back volume 35 in the casing 33 is performed either volumetrically or gravimetrically.

At Step S120, the carrier holding the acoustic device undergoing dosing is vibrated while the sound adsorber material 19 is being poured from the dosing hopper into the dosing funnel, and thence into the back volume 35 in the casing 33. If the sound adsorber material 19 is in powder, particle, or granulate form, vibrating the casing 33 while the sound adsorber material 19 is being poured into the back volume 35 via the dosing funnel allows the material to spread out relatively quickly and evenly.

At Step S130, the vibration of the carrier holding the casing 33 is hafted for a predetermined amount of time. The haft in vibration allows the sound adsorber material 19 that is now inside the back volume 35 in the casing 33 to settle. The settling of the sound adsorber material 19 is important for measuring whether the back volume has been properly filled.

At Step S140, the vibration of the carrier holding the casing 33 is resumed for a predetermined amount of time. The repeated vibration of the casing 33, both during and after the dosing step, is necessary to ensure that the sound adsorber material 19 inside the back volume 35 of the casing 33 has reached all cavities within the back volume 35. As noted before, the settling of the sound adsorber material 19 is important for measuring whether the back volume 35 has been properly filled. At the conclusion of the second vibration of the casing 33, the dosing funnel is removed.

At Step S150, the level of the sound adsorber material 19 inside the back volume 35 of the casing 33 is measured. The measurement can be done visually. More preferably, the level measurement is taken using a laser that illuminates the sound adsorber material 19.

At Step S160, the measured level of the sound adsorber material 19 in the back volume 35 is compared against the design requirements for the particular casing 33 being manufactured. If the level of sound adsorber material 19 is below design specifications, then, at Step S170, the casing 33 is rejected. If the level of sound adsorber material 19 is within design specifications, then the manufacturing process moves to Step S180.

At Step S180, the permeable member 43 is aligned with the top portions of the chamber walls 41 and the internal chamber wall 44, and attached thereto. The permeable member 43 will retain the sound adsorber material 19 in a designated volume within the back volume 35. As noted, the permeable member 43 can be coupled to the permeable member attachment points 42 on the top portions of the chamber wall 41 and the internal chamber wall 44 by gluing, crimping, stamping, embossing, heat sealing, or, preferably by ultrasonic welding. If an adhesive is used, preferably the adhesive does not have any outgassing characteristics that could affect performance of the sound adsorber material 19 in the back volume 35.

At Step S190, the chamber gasket 37 is aligned with the chamber walls 41 in the casing 33. As shown in FIGS. 5, 6 and 9, the chamber gasket rests on the top portion of the chamber walls 41, and is positioned over the permeable member 43 that is now attached to the chamber wall 41 at the permeable member attachment point 42. At this point in the assembly process, the acoustic transducer 34 can be placed into position in the casing 33. Alternatively, the acoustic transducer 34 can be mechanically attached to the printed circuit board 32, and then it will be maneuvered into position when the printed circuit board 32 is joined to the casing 33.

At Step S200, the printed circuit board 32 is aligned with the casing 33, and the two components are mated together to create the finished acoustic device. The mechanical attachment of the printed circuit board 32 and the casing 33 is accomplished with fasteners, suitable adhesives, and/or interlocking tabs molded into the respective components. If an adhesive is used, preferably the adhesive does not have any outgassing characteristics that could affect the sound adsorber material 19 in the back volume 35. The attachment of the printed circuit board 32 to the casing 33 creates a sealed acoustic chamber within the housing shell for the acoustic transducer 34.

At Step S210, the completed acoustic device is removed from the assembly carrier, and is tested to determine if it meets its design requirements.

Figure 11A:
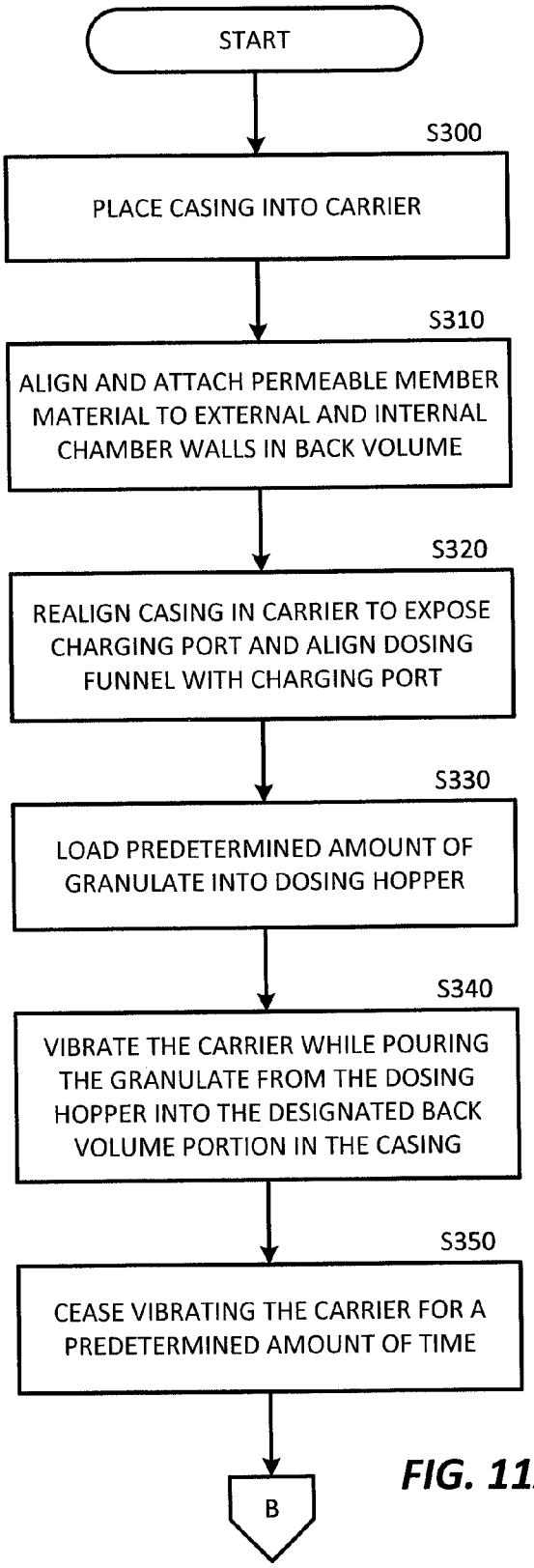
FIGS. 11A and 11B is a process flow for manufacturing an acoustic device where a casing and a printed circuit board of the acoustic device provide the acoustic chamber for the enclosed acoustic transducer and sound adsorber material according to an embodiment of the invention.
Figure 11B:
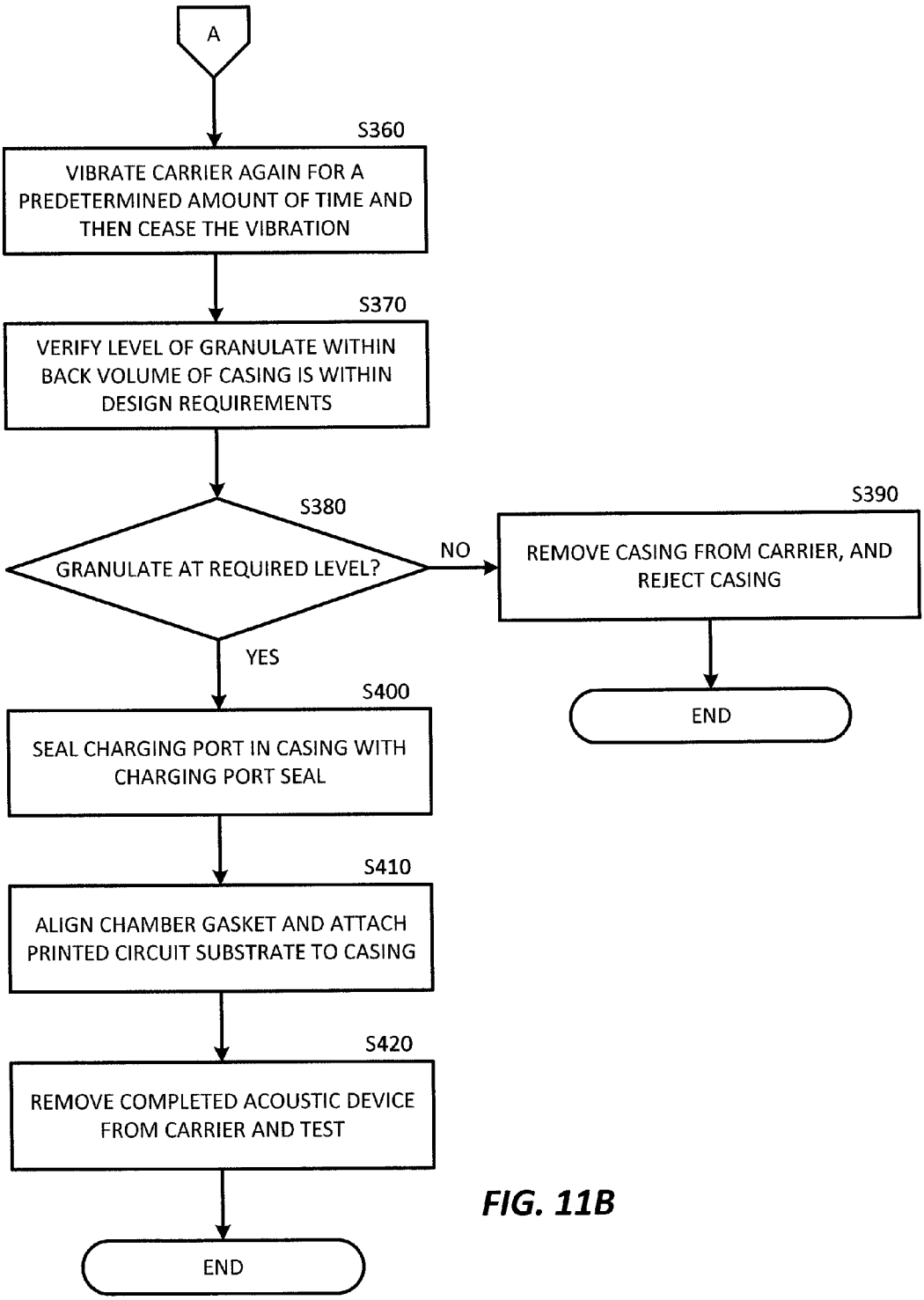

Referring to FIGS. 11A-11B, another method for manufacturing an audio device having a loudspeaker housing as an integral portion of its housing shell is disclosed. Preferably, the manufacturing method is implemented with computer-controlled manufacturing equipment for the greatest efficiency, although manual assembly of the audio device is contemplated as well. More specifically, the description of the manufacturing process assumes that the audio device undergoing assembly has been placed in an assembly carrier that moves the audio device through various computer-controlled assembly stations along an assembly track. There might be other steps, such as inserting gaskets or making electrical connections, that are not described in the manufacturing method. These types of steps, however, are generic to the manufacturing process and are not part of the invention.

Referring to FIGS. 11A and 11B, another embodiment of the manufacturing method for an audio device having a loudspeaker housing as an integral portion of its housing shell is disclosed will be described. At Step S300, the casing 33 is placed into an assembly carrier. At this stage of the manufacturing process, the audio device being assembled is situated in an assembly carrier, and, in some embodiments of the manufacturing process, will have to align the audio device being assembled at different angles during the manufacturing process.

At Step S310, the permeable member 43 is aligned with the top portions of the chamber walls 41 and the internal chamber wall 44, and attached thereto. The permeable member 43 will retain the sound adsorber material 19 in a designated volume within the back volume 35. As noted, the permeable member 43 can be coupled to the permeable member attachment points 42 on the top portions of the chamber wall 41 and the internal chamber wall 44 by gluing, crimping, stamping, embossing, heat sealing, or, preferably by ultrasonic welding. If an adhesive is used, preferably the adhesive does not have any outgassing characteristics that could affect performance of the sound adsorber material 19 in the back volume 35.

At Step S320, the casing is realigned in the assembly carrier to expose the charging port 52 so the dosing funnel can be aligned with the charging port 52. Preferably, the assembly carrier assists in the alignment of dosing funnel with the charging port 52, which will allow the sound adsorber material 19 to enter the back volume 35 in the casing 33. Alternatively, the dosing funnel can be manually aligned with the charging port 52 in the casing 33. The purpose of the dosing funnel is to ensure all the measured dose of sound adsorber material 19 enters the back volume 35 in the casing 33. Preferably, a zeolite material having a substantially spherical shape is used as the sound adsorber material 19, and the form of this zeolite material is preferable for filling the back volume of a closed casing 33. At this stage of the manufacturing process of the acoustic device, it is assumed that no other components need to be mounted in the casing 33, except for the acoustic transducer 34. While additional components can be added after the placement of the sound adsorber material 19 in the back volume 35, there is a risk of disturbing or contaminating the sound adsorber material 19.

At Step S330, a predetermined amount of the sound adsorber material is loaded into the dosing hopper. The amount of sound adsorber material that will be loaded into the back volume 35 in the casing 33 is determined based upon the desired acoustic effects that the designer wishes to achieve. For example, the amount of sound adsorber material 19 deposited into the back volume 35 in the casing 33 is dependent upon how much of a resonance shift the acoustic design engineer wishes to achieve. The measurement of the amount of sound adsorber material 19 for insertion into the back volume 35 in the casing 33 is performed either volumetrically or gravimetrically.

At Step S340, the carrier holding the acoustic device undergoing dosing is vibrated while the sound adsorber material 19 is being poured from the dosing hopper into the dosing funnel, and thence into the back volume 35 through the charging port 52 in the casing 33. If the sound adsorber material 19 is in powder, particle, or granulate form, vibrating the casing 33 while the sound adsorber material 19 is being poured into the back volume 35 via the dosing funnel and the charging port 52 allows the material to spread out relatively quickly and evenly.

At Step S350, the vibration of the carrier holding the casing 33 is hafted for a predetermined amount of time. The haft in vibration allows the sound adsorber material 19 that is now inside the back volume 35 in the casing 33 to settle. The settling of the sound adsorber material 19 is important for measuring whether the back volume has been properly filled.

At Step S360, the vibration of the carrier holding the casing 33 is resumed for a predetermined amount of time. The repeated vibration of the casing 33, both during and after the dosing step, is necessary to ensure that the sound adsorber material 19 inside the back volume 35 of the casing 33 has reached all cavities within the back volume 35. As noted before, the settling of the sound adsorber material 19 is important for measuring whether the back volume 35 has been properly filled. At the conclusion of the second vibration of the casing 33, the dosing funnel is removed.

At Step S370, the level of the sound adsorber material 19 inside the back volume 35 of the casing 33 is measured. The measurement can be done visually. More preferably, the level measurement is taken using a laser that illuminates the sound adsorber material 19.

At Step S380, the measured level of the sound adsorber material 19 in the back volume 35 is compared against the design requirements for the particular casing 33 being manufactured. If the level of sound adsorber material 19 is below design specifications, then, at Step S390, the casing 33 rejected. If the level of sound adsorber material 19 is within design specifications, then the manufacturing process moves to Step S400.

At Step S400, the charging port 52 is sealed with a charging port seal 53. The charging port seal 53 can be a plug-in seal that fits into the charging port 52, or a foil or film that is glued or attached to the charging port 52. The foil or film can be self-adhesive.

At Step S410, the chamber gasket 37 is aligned with the chamber walls 41 in the casing 33. As shown in FIGS. 5, 6 and 9, the chamber gasket rests on the top portion of the chamber walls 41, and is positioned over the permeable member 43 that is now attached to the chamber wall 41 at the permeable member attachment point 42. At this point in the assembly process, the acoustic transducer 34 can be placed into position in the casing 33. Alternatively, the acoustic transducer 34 can be mechanically attached to the printed circuit board 32, and then it will be maneuvered into position when the printed circuit board 32 is joined to the casing 33. Next, the printed circuit board 32 is aligned with the casing 33, and the two shells are mated together to create the finished acoustic device. The mechanical attachment of the printed circuit board 32 and the casing 33 is accomplished with fasteners, suitable adhesives, and/or interlocking tabs molded into the components. If an adhesive is used, preferably the adhesive does not have any outgassing characteristics that could affect the sound adsorber material 19 in the back volume 35. The attachment of the printed circuit board 32 to the casing 33 creates a sealed acoustic chamber within the housing shell for the acoustic transducer 34.

At Step S420, the completed acoustic device is removed from the assembly carrier, and is tested to determine if it meets its design requirements.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated.

It should be noted that any entity disclosed herein (e.g., the loudspeaker device, etc.) are not limited to a dedicated entity as described in some embodiments. Rather, the disclosed invention may be implemented in various ways and with arbitrary granularity on device level while still providing the desired functionality. It should be noted that the term "comprising" does not exclude other elements or steps and the "a" or "an" does not exclude a plurality. In addition, elements described in association with different embodiments may be combined. It should also be noted that reference signs in the claims should not be construed as limiting the scope of the claims. While specific embodiments have been illustrated and described, numerous modifications come to mind without significantly departing from the spirit of the invention, and the scope of protection is only limited by the scope of the accompanying claims. Further, acronyms are used merely to enhance the readability of the specification and claims. It should be noted that these acronyms are not intended to lessen the generality of the terms used and they should not be construed to restrict the scope of the claims to the embodiments described therein.

The invention claimed is:

1. A housing for a mobile device comprising:

a printed circuit substrate;

a casing configured to mate with the printed circuit substrate to create the housing for the mobile device, wherein the casing comprises:

a chamber wall that defines a substantially sealed acoustic chamber when engaged with an interior surface of the printed circuit substrate;

a chamber gasket interposed between the printed circuit substrate and the top portion of the chamber wall, wherein a thickness of the chamber gasket determines the size of a restriction through which gas exchange is facilitated;

an acoustic transducer disposed within the acoustic chamber;

a sound port that is acoustically coupled to the acoustic transducer;

an internal chamber wall disposed within the acoustic chamber and defining a back volume;

an amount of sound adsorber material disposed within the back volume; and a permeable member mechanically coupled to a top portion of the chamber wall and a top portion of the internal chamber wall, wherein the permeable member retains the sound adsorber material in a defined volume within the acoustic chamber.

2. An acoustic device comprising:

a printed circuit substrate;

a casing configured to mate with the printed circuit substrate, the casing comprising at least one external chamber wall, wherein the printed circuit substrate and the external chamber wall define a substantially sealed acoustic chamber when the casing is mated with the printed circuit substrate;

an acoustic transducer disposed within the acoustic chamber, the acoustic transducer defining a back volume within the acoustic chamber on a first side of the acoustic transducer and a front volume within the acoustic chamber on a second side of the acoustic transducer, opposite the first side;

a sound port disposed in the casing, the sound port being acoustically coupled to the acoustic transducer through the front volume;

an internal chamber wall disposed within the back volume of the acoustic chamber;

a permeable member mechanically coupled to a top portion of the chamber wall and a top portion of the internal chamber wall, wherein the permeable member, the chamber wall and the internal chamber wall form a defined space within the back volume; and an amount of sound adsorber material disposed within the defined space, wherein the permeable member is configured to retain the sound adsorber material in the defined space within the back volume the acoustic device, further comprising a chamber gasket interposed between the printed circuit substrate and the top portion of the chamber wall, wherein a thickness of the chamber gasket determines the size of a restriction through which gas exchange is facilitated.

3. The acoustic device according to claim 2, wherein the permeable member has low acoustic resistance and comprises one or more of a fleece material or a mesh material.

4. The acoustic device according to claim 3, wherein the sound adsorber material comprises granules and the pores of the material of the permeable member are adapted to be less than the size of the sound adsorber granules.

5. The acoustic device according to claim 2, wherein the permeable member is mechanically attached to the top portion of the chamber wall and the top portion of the internal chamber wall by gluing, crimping, stamping, embossing, heat-sealing, or ultrasonic welding.

6. The acoustic device according to claim 2, further comprising a sound port gasket interposed between the acoustic transducer and the sound port disposed in the casing, wherein the sound port gasket seals the front volume from the back volume.

7. The acoustic device according to claim 2, wherein the back volume portion of the acoustic chamber is partially filled with zeolite-based substantially spherical sound adsorber granules having a minimum diameter of at least 300 microns.

8. The acoustic device according to claim 2, wherein the back volume portion of the acoustic chamber is partially filled with a zeolite-based sound adsorber granulate having substantially spherical granules with a minimum diameter of at least 200 microns.

9. The acoustic device according to claim 2, wherein the back volume portion of the acoustic chamber is partially filled with a zeolite-based sound adsorber granulate having substantially spherical granules with a minimum diameter of at least 350 microns.

10. The acoustic device according to claim 2, wherein the internal chamber wall comprises an opening configured to facilitate gas exchange for the sound adsorber material, wherein the opening is covered by a material that has substantially the same acoustic resistance as the permeable member.

11. The acoustic device according to claim 10, wherein the material covering the opening of the internal chamber wall comprises one or more of a fleece material or a mesh material.

12. The acoustic device according to claim 2, wherein the internal chamber wall comprises an opening configured to facilitate gas exchange for the sound adsorber material, wherein the opening is covered by a material that has an acoustic resistance that is different from the permeable member.

13. The acoustic device according to claim 12, wherein the material covering the opening of the internal chamber wall comprises a gas impermeable material having multiple pores sized to retain the sound adsorber material in the defined space in the back volume.

14. The acoustic device according to claim 2, wherein the back volume portion of the acoustic chamber is partially filled with a zeolite-based sound adsorber granulate having substantially spherical granules with a minimum diameter of at least 300 microns and a maximum diameter of 900 microns.

* * * * *